United States Patent [19]

Forester et al.

[11] 4,253,643

[45] Mar. 3, 1981

[54] ESCAPE DEVICE

[76] Inventors: Glen R. Forester, 21296 - 8 Ave., Langley, British Columbia; Arnold M. Bernard, 1207 - 4758 Grange St., Burnaby, British Columbia, both of Canada

[21] Appl. No.: 32,514

[22] Filed: Apr. 23, 1979

[51] Int. Cl.[3] ..... B66D 1/00

[52] U.S. Cl. ..... 182/239

[58] Field of Search ..... 254/151, 157, 159, 171; 294/1 R; 214/DIG. 13; 182/5; 242/46.5

[56] References Cited

U.S. PATENT DOCUMENTS

| | | | |
|---|---|---|---|
| 990,029 | 4/1911 | Borden | 254/159 |
| 1,593,704 | 7/1926 | Morris | 254/157 |
| 2,122,315 | 6/1938 | Fosty et al. | 254/153 |
| 2,518,934 | 8/1950 | Renner et al. | 254/159 |
| 2,544,729 | 3/1951 | Schauer | 254/159 |
| 2,791,397 | 5/1957 | Coffman | 254/159 |

*Primary Examiner*—Leonard D. Christian
*Attorney, Agent, or Firm*—Carver and Company

[57] ABSTRACT

A fire escape having a cable-carrying drum mounted for rotation on a fixed shaft supported by a frame wherein the speed of rotation on the drum when the cable is laid out is governed by a centrifugally-operated braking device, one braking element of which is fixed rigidly to the shaft and the other element of which is slidably and rotatably mounted on the rigid shaft and provided with a gear connection to the drum, movement of the rotating brake element into frictional engagement with the fixed braking element by a centrifugal governor rotatably mounted on the shaft and rotated by virtue of geared connection to the drum.

3 Claims, 2 Drawing Figures

ESCAPE DEVICE

BACKGROUND OF THE INVENTION

1. Field of the Invention

This invention relates to fire escapes, and in particular to the type of fire escape which can be mounted adjacent a window and used by a person to descend by cable in a safe manner.

2. Prior Art

Of the many and varied types of emergency fire escapes, one of the types that could be most practical which is rarely seen, are the types which can be suspended from the individual windows or doors of a building and which can be operated to allow escapees to descend by cable. To this end, certain escape devices have been made which embody a drum reel on which a cable is wound and which can be mounted adjacent a door or window of a building and which also has a governing system arranged to govern rotation of the reel as the cable is paid out so that an escapee is lowered safely to the ground and which can then be operated to reel in the extended cable for use by somebody else.

One of the problems associated with these types of escape devices is that they are quite often left outside the buildings after use and working components thereof are therefore subject to rust and the like which can render them unsafe. Also they must be relatively light so that they can be handled easily by people in emergency situations. Escape devices of this type of prior art have usually embodied a heavy protective casing in which the reel and the governing components are mounted and which is strong enough to withstand without deformation lateral of forces generated by governor components. Such devices are difficult to handle in emergency situations.

SUMMARY OF THE INVENTION

The present invention provides a fire escape of the last mentioned type which is sufficiently light to render it capable of being stored in a room and, if required, manually positioned and engaged with a hook or like device near a window for use. The escape device of the present invention furthermore does not require a heavy supporting and protective frame as all of the governing components thereof are incorporated inside the reel or drum and therefore are adequately protected against effects of rain and the like.

The fire escape of the present invention comprises a supporting frame, a shaft non-rotatably supported by the frame, a reel rotatably mounted on the shaft, and a centrifugal governor mounted on the shaft within the drum and having a gear connection to the drum to govern rotational speed of the drum, the gear connection incorporating a cam clutch automatically operable to disengage the drum and governor when the reel is rotated in a direction to wind the cable thereon.

A detailed description following, related to the drawings, gives exemplification of apparatus according to the invention which, however, is capable of expression in means other than those particularly described and illustrated.

DETAILED DESCRIPTION

Figure 1:
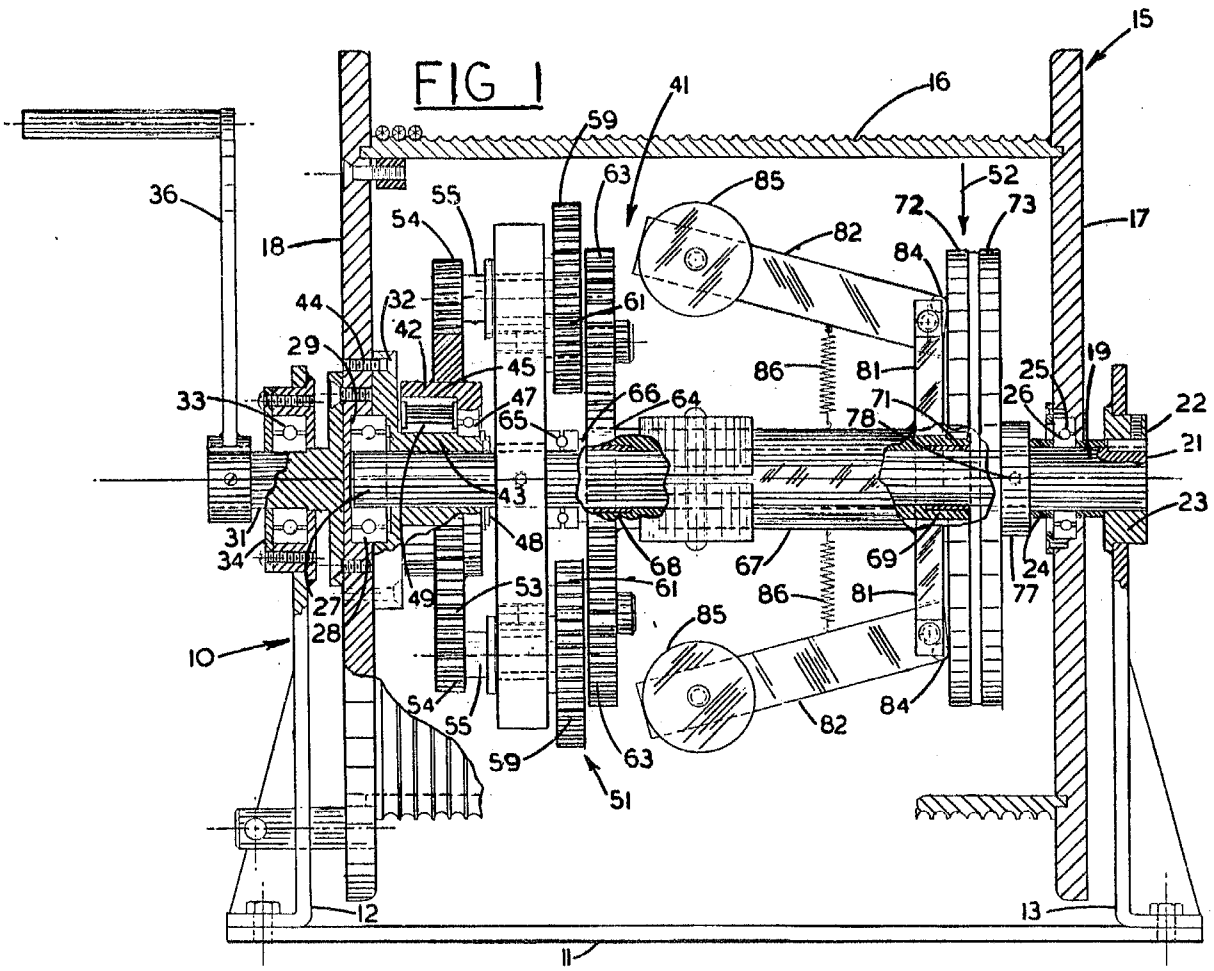
FIG. 1 is a central sectional view of the fire escape with portions thereof broken away for purposes of clarification.

Referring to the drawings, the escape device includes a frame 10 having a base 11 which can be secured to a wall, or the like, near a window and a pair of spaced upright stanchions 12 and 13 secured to the base. The device also includes a drum 15 having a hollow cylindrical core 16 having a flanged end wall 17 secured thereto by welding, or the like, and a flanged end wall 18 which has a bolted connection thereto.

The drum is mounted for rotation in the frame on a fixed shaft 19, one end 21 of which is grooved to take a key 22 for non-rotatably connecting the shaft and a receiving head 23 on the stanchion 13. The drum is spaced upon the receiving head by a spacer 24 which fits against a bearing 25 which fits in a bearing seat 26 in the end wall 17 and within which the shaft is rotatably supported. The opposite end 27 of the shaft is journalled in the end wall 18 of the drum in a bearing 28 which fits in a corresponding seat 29 of said end wall.

A stub axle 31 is mounted by bolts 32 on the outer surface of end wall 18 in line with the shaft 19 and is rotatably supported in bearings 33 mounted in a head 34 on the stanchion 12. A crank 36 is mounted on the stub axle 31 to provide means whereby the drum can be manually rotated.

Figure 2:
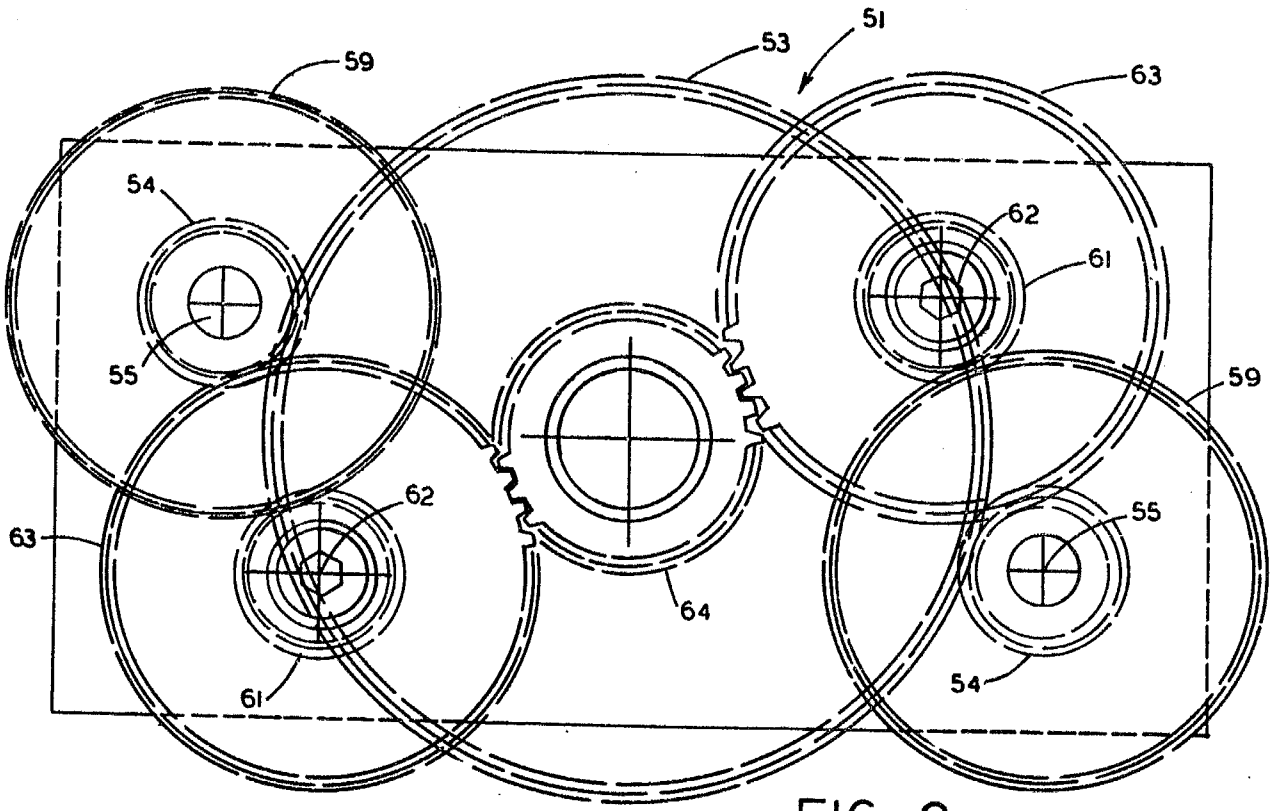
FIG. 2 is a diagramatic representation of a gear train taken in the direction 2—2 of FIG. 1.

The device also includes a centrifugal governor assembly, generally 41, which is enclosed entirely in the drum. The assembly 41 includes a cam clutch assembly 42 having an inner race 43 which is bolted by bolts 44 to the end wall 18 and which bears against the bearing 28 and an outer race 45 rotatably supported on the inner race by a bearing 47 which is held on the inner race by a circlet 48. The cam clutch, as is conventional with this type of clutch, also has jamming rollers 49 between the inner and outer races. The cam clutch links the drum, when the cable is reeled therefrom, in driving engagement through a gear train 51 to a centrifugally-operated friction brake 52. The gear train, see also FIG. 2, includes a large diameter spur gear 53 mounted on the outer race for rotation therewith and which meshes with a pair of samll diameter spur gears 54—54 mounted on shafts 55—55 which are mounted for rotation in a gear carrier 56 which is fixed on the shaft 19 against longitudinal and rotational movement relative thereto by set screw 57. Large diameter spur gears 59—59 are mounted on the shafts 55—55 and drive small diameter spur gears 61—61 which are mounted on shafts 62—62 journalled in the carrier for rotation. The shafts 62—62 carry large diameter spur gears 63—63 which mesh with the small diameter spur gear 64 encircling the shaft 19. The spur gear 64 which is spaced from the carrier 56 by a thrust bearing 65 and spacer 66 is non-rotatably mounted, as by welding, on one end of a tubular drive shaft 67 mounted in bearings 68 and 69 on the shaft 19. The opposite end 71 of the tubular drive shaft is splined to receive a cooperating spline of an annular friction plate 72. The annular friction plate 72 confronts a corresponding annular friction plate 73 mounted on the shaft 19 and which has a collar 77 and set screw 78 which secures the last mentioned friction plate to the shaft 19 against rotational and longitudinal movement.

Mounted on the tubular drive shaft adjacent a friction plate 72 are a plurality of laterally extending supports 81 at the end of each of which is swingably mounted an arm 82, each of the arms having at its outer corner a roller 84 which makes rolling engagement with the friction plate 72. Weights 85 are mounted on the free ends of the arms and retractile springs 86 extend between the arms and the tubular drive shaft normally tending to move the arms inwards towards the shafts to a retracted position. Proportionment of the parts is such that when the arms are swung outwards against their retractile springs the rollers move into camming engagement with the friction plate 72 slidably moving the latter into frictional engagement with the friction plate 73 thus applying a braking force.

In operation the escape device can be stored inside a room and, when needed, supported by the frame to one side of a door or window on a hook not shown. The escapee need only then attach a cable harness (not shown) to himself to which is attached the cable and then let himself depend from the cable. As the drum, under the weight of the escapee, starts to rotate, the cam clutch will automatically engage the drum with the governor assembly causing the friction plate 72 to rotate through the train of gears thereby causing the arms 82 to move out against their rectractile springs and thereby move the friction plate 72 into frictional engagement with the friction plate 73 which will thus govern the rate of rotation of the drum and consequently the descent of the escapee. When the escapee has reached the ground, he can simply detach himself from the harness and a person who wishes to make a descent can reel in the cable by simply operating the crank to rotate the drum in the reverse direction, the cam clutch disengaging the governor assembly from the drum in this latter operation.

It is evident having regard to the construction of the escape device that pressure between the friction plates required to control the rate of descent of the escapee is transferred directly to the shaft 19. None of the axial force is transferred to the drum or the frame and thus avoids spreading of the frame members and drum members with the likelyhood of improper operation of the escape device. Further it is seen that all of the speed governing components are incorporated within the drum and are thus protected so that heavy framing and covering normally associated with this type of escape device is not necessary.

I claim:

1. A fire escape device comprising:

(a) a supporting frame having a pair of spaced apart support members, (b) a shaft non-rotatably mounted at one end in one of the support members, (c) a winding drum rotatably mounted on the shaft and adapted to have a cable wound thereon, (d) a stub shaft extending from one end of the drum rotatably supported by the other support member of the frame, (e) a first friction plate mounted on the shaft against rotative and linear movement, (f) a tubular governor carrier mounted for rotation on the shaft, (g) gear means connecting the drum in driving engagement with the carrier, (h) a second friction plate mounted on the carrier for rotation therewith and longitudinally slidable thereof, (i) centrifugally actuated governor means mounted on the governor carrier for moving the second friction plate into engagement with the first friction plate so as to apply a braking force to the winding drum as the latter rotates.

2. An escape device as claimed in claim 1 including over-running clutch means in the gear means between the drum and the governor carrier for disassociating the drum and carrier when the drum is rotated in a direction for winding the cable thereon, and a handle mounted on the stub shaft for manually rotating the drum.

3. An escape device as claimed in claims 1 or 2 in which the gear means includes:

(a) a gear carrier mounted on the shaft against rotative and longitudinal movement relative thereto, (b) a gear train mounted on the gear carrier, (c) a gear mounted on the drum in driving engagement with the gear train, (d) a gear mounted on the tubular carrier in driven engagement with the gear train and a thrust bearing mounted on the fixed shaft between the gear carrier and tubular carrier.

* * * * *